United States Patent [19]

Chun et al.

[11] Patent Number: 4,813,851

[45] Date of Patent: Mar. 21, 1989

[54] PROCESS AND APPLIANCE FOR CONVEYING LIQUID OR GASEOUS FLUIDS

[75] Inventors: Chung-Hwan Chun, Gleichen; Georg Koppenwallner, Göttingen, both of Fed. Rep. of Germany

[73] Assignee: Deutsche Forschungs- und Versuchsanstalt für Luft- und Raumfahrt e. V., Cologne, Fed. Rep. of Germany

[21] Appl. No.: 28,450

[22] Filed: Mar. 20, 1987

[30] Foreign Application Priority Data

Mar. 29, 1986 [DE] Fed. Rep. of Germany ..... 3610674

[51] Int. Cl.[4] ..... F04F 11/00; F17D 1/16

[52] U.S. Cl. ..... 417/54; 417/65; 417/572; 137/13

[58] Field of Search ..... 417/52, 54, 65, 207, 417/240, 572; 137/13

[56] References Cited

U.S. PATENT DOCUMENTS

| | | | |
|---|---|---|---|
| 3,659,960 | 5/1972 | Dunlop | 417/52 X |
| 4,147,481 | 4/1979 | Deutsch | 417/572 |
| 4,223,539 | 9/1980 | Webb et al. | 62/494 X |
| 4,376,046 | 3/1983 | Deutsch | 417/207 X |
| 4,615,760 | 10/1986 | Dressler | 156/620 |
| 4,640,667 | 2/1987 | Trepp | 417/52 |

OTHER PUBLICATIONS

L. E. Scriven et al., The Marangoni Effects, Nature, Jul. 16, 1960, vol. 187, pp. 186–187.

Carruthers et al., Studies of Floating Liquid Zones in Simulated Zero Gravity, J. Applied Physics, Feb. 1972, vol. 43, No. 2, pp. 436–445.

*Primary Examiner*—Paul F. Neils

*Attorney, Agent, or Firm*—Thomas & Thomas

[57] ABSTRACT

Process and appliance for conveying liquid or gaseous fluids, this process involving no mechanically movable propelling elements, but rather the formation, on the fluid that is to be conveyed, of interfaces with an additional fluid, and the application of a tension gradient at these interfaces, so that the so-called Marangoni effect is utilized for propelling the conveying stream.

22 Claims, 4 Drawing Sheets

PROCESS AND APPLIANCE FOR CONVEYING LIQUID OR GASEOUS FLUIDS

BACKGROUND OF THE INVENTION

The present invention relates to a process for conveying liquid or gaseous fluids, and to an appliance for carrying out this process, which does not involve mechanically operated propelling elements.

For various applications, especially in space laboratories, where reduced-gravity conditions prevail, it is necessary to have recourse to pumps which function successfully without any need for moving propelling elements, and which exhibit no residual acceleration. Pumps which function successfully without moving propelling elements are already known, those which utilize thermal convection representing one example. However, these known pumpms cannot be employed in space laboratories because they tend to rely on gravity for their operation.

SUMMARY OF THE INVENTION

The object of the present invention is to provide a process and an appliance which enable a fluid to be conveyed, even under space conditions, and especially in the absence of gravity, without at the same time requiring mechanically movable propelling elements, and without concurrent residual accelerations.

This object is achieved, according to the invention, by arranging for an interface with an additional fluid to be formed on the fluid that is to be conveyed, and for a tension gradient to be created at this interface, so that the so-called Marangoni effect is utilized for propelling the conveying stream. This effect has already been known for a long time, and detailed descriptions of it are available in the literature.

The Marangoni effect characterizes a phenomenon that occurs at the interface between two non-miscible fluids when the surface tension of the interface is not constant, i.e., when a surface tension gradient exists. In general terms, a flow of fluid is established along the interface in the direction of increasing surface tension and continues as long as the surface tension gradient is maintained. Because of the viscosity of the fluid, successive layers of fluid below the interface are "dragged along" by the Marangoni currents such that a general current in the fluid is established in the direction of the Marangoni currents.

In the current invention, the Marangoni effect is utilized for conveying a stream of fluid. Unlike thermal convection, this effect does not depend on gravity, and can hence be used even in a space laboratory. In the case of this effect, gravity actually happens to exert a somewhat adverse influence although the effect can be utilized for pumping in a gravitational field. This apart, metering is possible down to extremely low flow rates.

The tension gradient is preferably created by means of a temperature gradient, or by a gradient in the concentration of a component which is dissolved in the fluid, or by an electrical charge gradient. Such means allow non-mechanical energy to be converted directly into kinetic energy, without mechanically operated propelling elements. Moreover, a dual function is achievable, i.e. mass transfer and transport of dissolved components.

The fluids must not mix with one another, so that an interface can be formed. Furthermore, the pressures on the opposite sides of the interface can be balanced through the liquids or, rather, a given pressure can be set at the interface.

It is expedient if the interfaces bounding the fluid to be conveyed are located between a feed line and a discharge line, a surface tension gradient being formed along these interfaces, i.e. between the feed line and the discharge line. Such an arrangement is exceptionally simple in constructional terms. No moving parts are present, so that a high degree of resistance to interference or breakdown is achievable.

The feed line and the discharge line are of tubular configuration, and are arranged in a manner such that they are separated by a certain distance, so that the interfacial surface bounding the fluid to be conveyed can be located between the tube walls. With this arrangement, the interface is likewise caused to assume a tubular form. Moreover, the conveying stream runs in a straight line from the feed tube to the discharge tube. As a result of the tension gradient relative to an adjacent fluid, the conveying stream experiences a propulsive effect at the interfacial surface within the gap between the tube ends, without any need for movable propelling elements.

The fluid adjacent to the one to be conveyed is preferably contained in a chamber, into which the feed line and discharge line extend. The pressure prevailing in the chamber can be altered by simple means. This is necessary in orer to be able to adjust the interfaces between the two fluids, as desired.

Several of these pumps can be interconnected, in parallel and/or series, thus enabling the conveying capacity to be increased.

BRIEF DESCRIPTION OF THE DRAWINGS

Detailed explanations of several embodiments of the invention will be given in the course of the following description, which is referred to the accompanying drawings, wherein

FIG. 6 shows an apparatus for producing an electrical charge graident on the interface.

DETAILED DESCRIPTION

Figure 1:
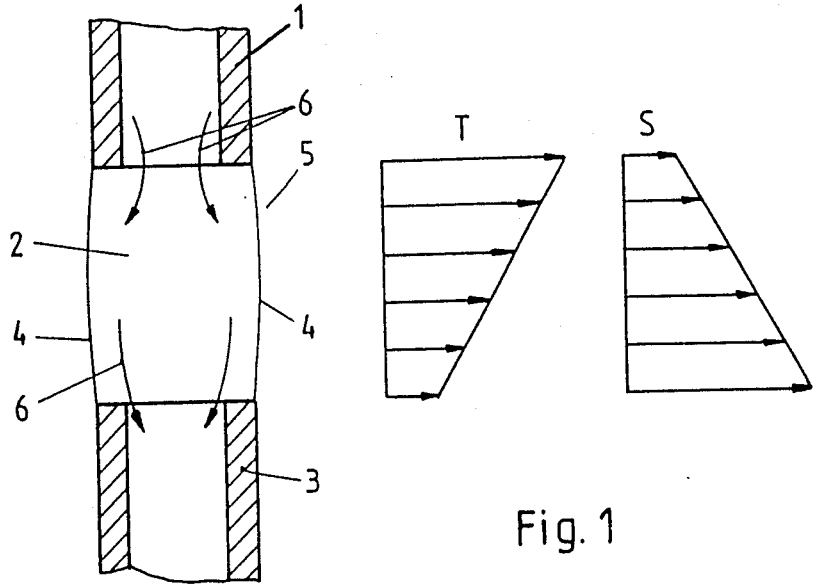
FIG. 1 shows a schematic representation of the pump, so as to explain the principle on which it functions.

FIG. 1 is a schematic representation of the pump according to the invention. The fluid 2, which is to be conveyed, is led from a feed tube 1 and into a discharge tube 3. The tubes 1 and 3 are aligned so that they are coaxial with one another, and a small gap is provided between them. The fluid 2 forms a cylindrical interface 4 between the tubes 1 and 3. An additional fluid 5, which can, for example, be the surrounding air, is situated outside the interface 4. A surface tension gradient is now created at the interface 4. For this purpose, it is possible, for example, to employ a temperature gradient between the feed tube 1 and the discharge tube 3. As can be seen from the diagram at the side, the lower tube 3 is cold, so that the temperature T increases in the upward direction, i.e. towards the feed tube 1. This temperature gradient causes the surface tension s at the interface 4 to increase in the downward direction, as can be appreciated from the diagram. Under these conditions, motion occurs along the interface in the direction of increasing surface tension and this motion giving rise to a general fluid flow in the direction of the arrows 6, due to the viscosity that is always present. This effect is called the Marangoni effect. Instead of a temperature gradient, it is also possible to use a concentration gradient, or an electrical charge gradient.

A concentration gradient can be achieved, for example, by introducing a surfactant such as a detergent to the interface 4 adjacent the lip of the feed tube 1. The surfactant reduces the surface tension on the interface 4 adjacent the feed tube causing an increasing tension gradient along the interface in the downward direction in FIG. 1. This surface tension gradient gives rise to fluid flow through the Marangoni effect as discussed. Alternatively, the required surface tension gradient can be induced through an electrical charge gradient. Such a charge gradient could be achieved, for example, by generating a net positive charge on the interface of the conducting fluids, such as on the interface between mercury and Electrolyte ($H_2SO_4$), using, for example, a battery, and causing a potential difference between two electrodes located adjacent the lips of the feed and discharge tubes, respectively. The positive charges along the interface 4 will tend to migrate toward the negative electrode inducing a charge gradient between the feed tube and the discharge tube. This charge gradient, in turn, causes a surface tension gradient along the interface giving rise to the Marangoni effect.

FIG. 6 illustrates, as an example, one embodiment of an apparatus for producing the electrical charge gradient. In this figure, an electrolytical vessel 24 surrounds the interface 4. The electrolyte is charged positively by electrodes 25 and 26 which are connected through voltage divider 27 to battery 28. An electrical potential is established across electrodes 29 and 30 via battery 31 and voltage divider 32. This causes positive charges on the interface to migrate toward the feed tube 2 inducing a surface tension gradient on the interface. The flow occurring here does not depend on gravity, so that a pump of this type can also be used in a space laboratory. Since no movable propelling elements of any kind are present, interfering "proper" accelerations do not occur, this being very important in the context of various materials-processing operations that may be undertaken in space laboratories. Contamination of the fluid to be conveyed is likewise precluded.

Figure 2:
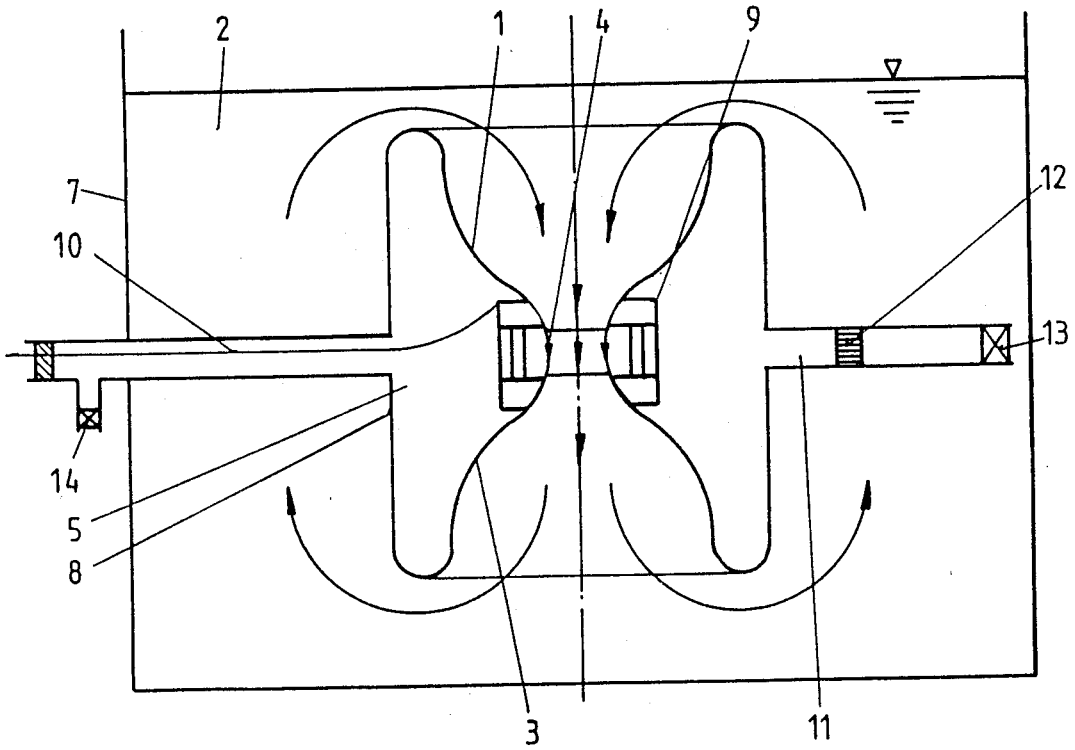
FIG. 2 shows a section through a pump with a pressure-balancing chamber.

In FIG. 2, a pump is shown in section. The fluid 2, which is to be conveyed, is situated inside a container 7. The feed line 1 and the discharge line 3 are housed in this container. A chamber 8, for the additional fluid 5, is provided on the outside of these lines. A device 9, for example an electric heater, is installed in order to create the tension gradient at the interface 4. Power is supplied to this heating device 9 via a lead 10. In order to enable a stable cylindrical interface 4 to be obtained, an arrangement is provided for balancing the pressures in the fluids 2 and 5 at the interface level. This is effected by means of a cylinder 11, containing a slidable piston 12. Valves 13 and 14 are provided and adapted to be opened to allow the piston 12 to move freely as equilibrium pressure is established between the two fluids. After equilibrium is established, the valves can be closed to maintain the piston 12 at the position corresponding to the pressure equilibrium of the fluids. With this arrangement, the piston 12 shifts until there is no difference between the pressures in the fluids 2 and 5 at the level of the interface 4. The valves are then closed and the piston is maintained at the equilibrium position. To some extent, therefore, pressure-balancing is automatic. At the same time, the shut-off facilities 13 and 14 must be opened or closed as required.

Figure 3:
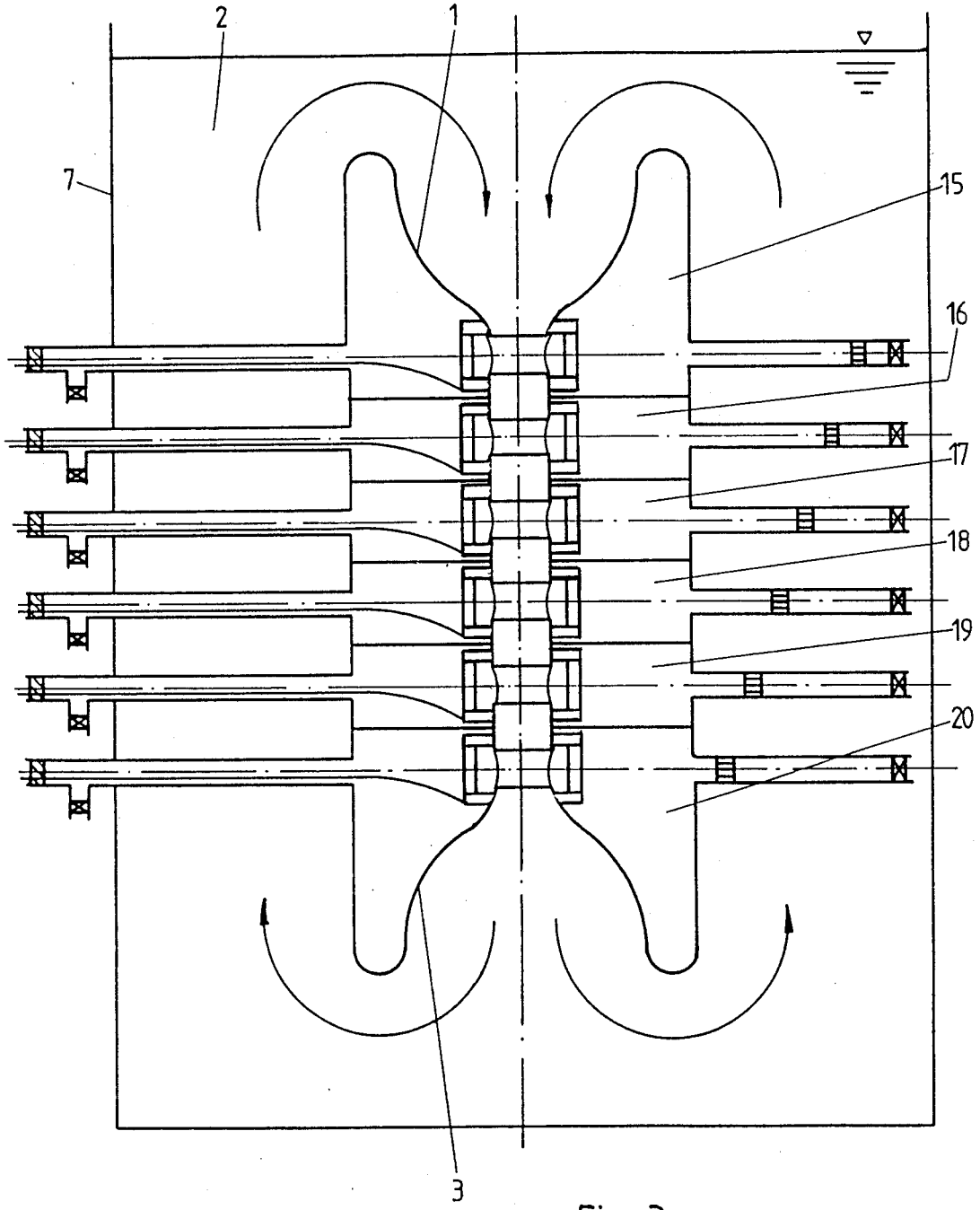
FIG. 3 shows a group of pumps, of the type shown in FIG. 2, connected in series.

FIG. 3 shows a group of pumps, in a series-connected arrangement which results in a higher delivery pressure. The mode of operation is nevertheless the same as that which has already been described. Here, each stage possesses its own pressure-balancing chamber, so that pressure-balancing is possible for each of the levels at which the corresponding interfaces are situated. The desired delivery pressure determines the number of pumps to be connected in series.

Figure 4:
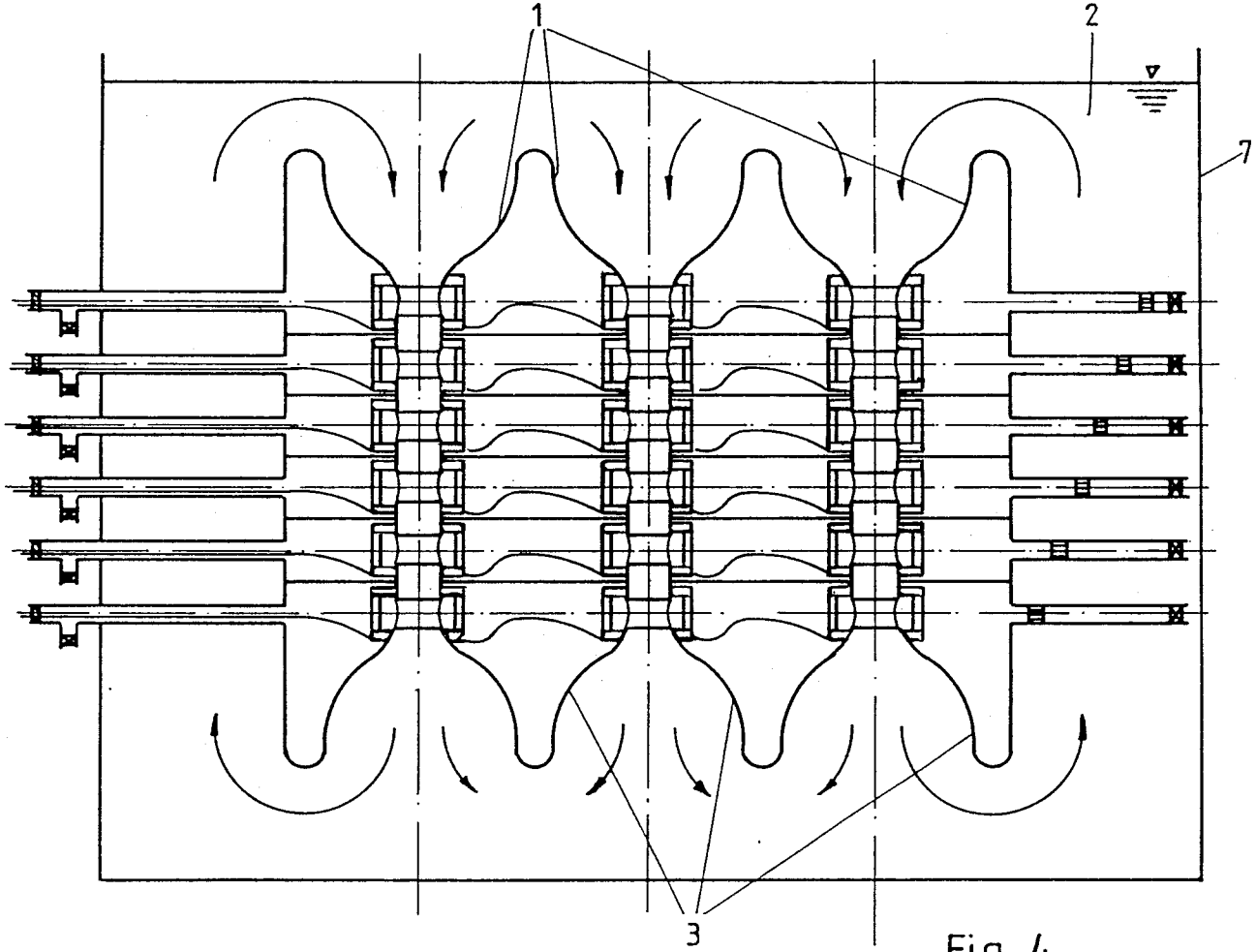
FIG. 4 shows a group of pumps, of the type shown in FIG. 2, connected both in series and in parallel.
Figure 5:
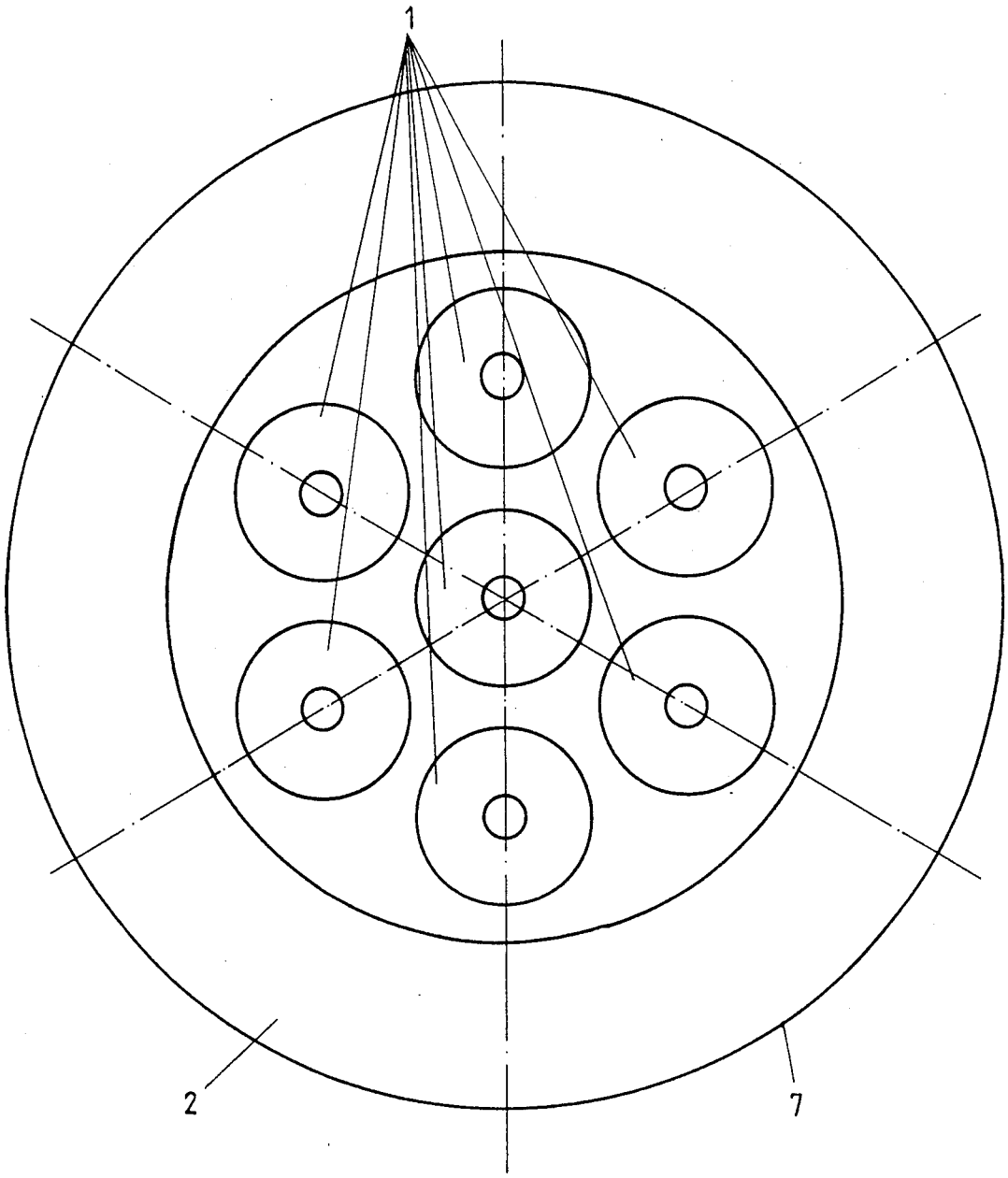
FIG. 5 shows a plan view of the group of pumps shown in FIG. 4.

In FIG. 4, the pumps are provided in a series/parallel connection arrangement. This enables a greather throughput to be achieved. FIG. 5 shows this pump in plan view.

In addition to conveying a fluid, the pump can also be used for bringing about mass transfer. When this mode of operation is desired, using the pump shown in FIG. 3, the fluid in the chambers 15–17 can contain a dissolved component. At the same time, the adjoining chambers 18–20 contain a fluid with another component, B. If, now, the fluid that is to be conveyed, namely the fluid 2, flows past the corresponding interfaces within the chambers 15–17, the component A diffuses into it, and is separated out again at the interfaces within the chambers which follow, namely the chambers 18–20. In the same way, the component B is taken up at this interfaces, and separated out again at the others. The mass transfer and transport take place between the chambers 15–17, in the one case, and between the chambers 18–20, in the other.

We claim:

1. Appliance for conveying liquid or gaseous fluids of the type in which an interface with a second fluid is formed on the fluid to be conveyed and a surface tension gradient is created along the interface so that the Marangoni effect is utilized for propelling the fluid to be conveyed, said appliance being characterized by a feed line and a discharge line, means for forming interfaces bounding the fluid to be conveyed between said feed line and said discharge line, and means for forming a surface tension gradient at the interfaces of the fluids between the feed line and the discharge line.

2. Appliance according to claim 1, characterized in that the feed line and the discharge line are of tubular configuration and are arranged in a manner such that they are separated by a gap, the gap being bridged by the interfacial surface boundary of the fluid to be conveyed.

3. Appliance according to claim 2, characterized in that the interfaces are of tubular form.

4. Applicance according to claim 1 characterized in that the feed line and the discharge line extend into a chamber for the second fluid.

5. Appliance according to claim 4, characterized in that the chamber is equipped with a pressure-balancing arrangement.

6. Appliance according to claim 1 characterized in that several of these appliance are interconnected in parallel.

7. Appliance according to claim 1 characterized in that several of these appliances are interconnected in series.

8. An apparatus for conveying a first fluid by utilizing the Marangoni effect, said apparatus comprising:

a feed tube having an end portion;

a discharge tube having an end portion;

said feed tube end portion being maintained in spaced generally coaxial relationship relative to said discharge tube end portion to define a gap therebetween, the distance between said end portions of said tubes being sufficient to allow a portion of said first fluid to be maintained within the gap under the influence of its surface tension with the surface of said portion of the first fluid being exposed between the end portions of the tubes;

means for maintaining a second fluid in contact with the surface of said first fluid whereby an interface is formed between said exposed surface of the first fluid and the second fluid; means for establishing a surface tension gradient along said interface with the surface tension increasing in a direction from the end portion of the feed tube substantially toward the end portion of the discharge tube, whereby fluid movement according to the Marangoni effect occurs along the interface in the direction of increasing surface tension causing movement of said first fluid from said feed tube to said discharge tube.

9. The apparatus of claim 8 wherein the feed line and the discharge line are of tubular configuration and wherein the gap is bridged by the interfacial surface bounding the fluid to be conveyed from the feed tube to the discharge tube.

10. The apparatus of claim 9 wherein the interfacial surface is of tubular form.

11. The apparatus of claim 8 further comprising means for allowing the pressure between the second fluid and the first fluid to equalize and maintaining the pressure at the equilibrium level.

12. Process for conveying liquid in gaseous fluids from a feed line to a discharge line, which does not involved mechanically movable propelling elements, characterized by forming an interface between the feed line and the discharge line with a second fluid on the fluid that is to be conveyed, and creating a tension gradient along this interface, so that the Marangoni effect is utilized for propelling the fluid to be conveyed from the feed line to the discharge line.

13. Process according to claim 12, characterized in that the tension gradient is created by a temperature gradient.

14. Process according to claim 12 characterized in that the fluids are mutually immiscible.

15. Process according to claim 12 characterized in that the second fluid is used for pressure-balancing.

16. Process according to claim 12, characterized in that the tension gradient is created by a gradient in the concentration of a component which is dissolved in the fluid.

17. Process according to claim 12, characterized in that the tension gradient is created by an electrical charge gradient.

18. A method of conveying a first fluid through a feed tube and a discharge tube, said method comprising the steps of:

filling the feed tube and the discharge tube with the first fluid;

surrounding the end portions of the feed tube and the discharge tube with a second fluid, said second fluid and said first fluid being immiscible;

separating the end portions of the tubes to define a gap therebetween with the gap having a size sufficient to allow a portion of the first fluid to be maintained under the influence of its surface tension within the gap creating an interface between the surface of the first fluid and the second fluid;

establishing a surface tension gradient along the interface between the first and second fluids with the surface tension increasing in a direction from the end portion of the feed tube substantially toward the end portion of the discharge tube, whereby fluid flow occurs along the interface toward the discharge tube as a result of the Marangoni effect causing the first fluid to move from the feed tube to the discharge tube.

19. The method of claim 18 wherein the step of creating a surface tension gradient comprises the step of establishing a temperature gradient along the interface with the temperature increasing substantially in a direction from the discharge tube to the feed tube.

20. The method of claim 18 wherein the step of creating a surface tension gradient comprises the step of introducing a surface tension reducing component to the interface adjacent the end portion of the feed tube with the component being soluble in the first fluid, whereby a component concentration gradient and consequently a surface tension gradient is established in a direction substantially from the feed tube to the discharge tube.

21. The method of claim 18 wherein the step of creating a surface tension gradient comprises the step of establishing an electrical charge gradient along the interface with the electrical charge becoming increasingly more positive in a direction substantially from the discharge tube to the feed tube.

22. The method of claim 18 further comprising the steps of allowing the pressure between the second fluid and the first fluid to equalize and maintaining the pressure at the equilibrium level.

* * * * *